US005808277A

United States Patent [19]

Dosani et al.

[11] Patent Number: 5,808,277

[45] Date of Patent: Sep. 15, 1998

[54] PROGRAMMABLE THERMOSTAT TO REDUCE BACTERIAL PROLIFERATION TO PREVENT LEGIONELLOSIS

[76] Inventors: Nazir Dosani, 8 Harris Way, Thornhill, Ontario, Canada, L3T-5A7; Nizar Ladha, 192 Harrision Drive, Newmarket, Ontario, Canada, L3Y-4B6

[21] Appl. No.: 662,970

[22] Filed: Jun. 13, 1996

[30] Foreign Application Priority Data

Jun. 15, 1995 [CA] Canada ..... 2151881

[51] Int. Cl.[6] ..... H05B 1/02

[52] U.S. Cl. ..... 219/481; 392/441; 392/454; 392/463; 219/486; 219/501

[58] Field of Search ..... 219/481, 483, 219/485, 486, 501, 505, 506, 412, 413; 392/441, 463, 464, 442–445, 454

[56] References Cited

U.S. PATENT DOCUMENTS

| | | | |
|---|---|---|---|
| 4,508,261 | 4/1985 | Blank | 236/20 R |
| 4,529,121 | 7/1985 | Furth | 236/46 R |
| 4,765,351 | 8/1988 | Clary | 134/56 D |
| 4,978,833 | 12/1990 | Knepler | 392/449 |
| 5,103,078 | 4/1992 | Boykin et al. | 219/494 |
| 5,103,801 | 4/1992 | Herring et al. | 126/374 |
| 5,168,546 | 12/1992 | Laperriere et al. | 392/454 |
| 5,229,579 | 7/1993 | Ingraham et al. | 219/202 |

*Primary Examiner*—Mark H. Paschall

[57] ABSTRACT

A domestic electric water heater comprises a cylindrical tank having a vertical wall and a curved bottom, the latter defining with the vertical wall an annular stagnant water zone susceptible of bacterial contamination by, for example, legionella bacteria. The tank is provided with an upper immersion heating element and a lower immersion heating element, the latter being located above to the annular zone of contamination. The programmable thermostat turns on the lower immersion element until the preset temperature is sensed by the temperature sensor at the upper immersion heating element. This concept elevates the whole tank including the annular zone of contamination to a higher temperature setting and thus eliminate the danger of bacterial contamination.

15 Claims, 7 Drawing Sheets

PROGRAMMABLE THERMOSTAT TO REDUCE BACTERIAL PROLIFERATION TO PREVENT LEGIONELLOSIS

FIELD OF THE INVENTION

This invention relates to water heaters. In particular, this invention relates to a method and apparatus for controlling the temperature in a water heater.

BACKGROUND OF THE INVENTION

Since the discovery, in 1976, of Legionella pneumophila, commonly called the legionellosis, numerous studies have been made in order to understand better the agents having an effect upon the proliferation of this bacterium which found, as it has since been discovered, particularly at the bottom of domestic electric water heaters. It is known that the legionellosis does not grow nor survive at temperatures above 46 degree C.

Laperriere et al. (U.S. Pat. No. 5,168,546) teaches that by adding and extra heating element to outside bottom side of the hot water tank eliminates the legionellosis. This is difficult to do in the field and also expensive as extra parts have to be added. Further more the production process has to be changed to accommodate the extra heating element.

The present invention relates to a method and apparatus for controlling the temperature of water in a water heater. The invention is able to regulate bacterial growth, by periodically elevating the temperature of water throughout the water tank beyond the preset consumption temperature to a sanitizing temperature, to destroy bacteria.

The invention accomplishes this by providing a programmable thermostat which is in a preferred embodiment responsive to over/under voltage conditions in the power supply. The thermostat is connected to the temperature sensors associated with each heating element, and during ordinary operating conditions conventionally maintains the heated water at preset consumption temperature, typically, between 50 degree C. and 60 degree C. Upon detecting an over/under voltage swing in the power supply voltage exceeding a preset level, which may be about 7% beyond the nominal voltage, the thermostat automatically activates heating elements to super heat water in the tank to a sanitizing temperature, for example 65 degree C. to 70 degree C., for a preset sanitizing cycle. Thus, during the sanitizing cycle all of the water in the tank is heated to the sanitizing temperature and bacterial growth is thereby destroyed. One advantage of this method of controlling the temperature of water in the water heater is that a power supply over/under voltage can be deliberately created by a local electrical power utility company whenever it is deemed necessary. A further advantage is that a power supply over voltage occurs naturally during low electrical demand periods, which is the best time to over heat water in the water heaters form the power utility's standpoint, because by definition excess electrical power is available for doing so. Moreover, such low electrical demand periods are likely to correspond closely with low hot water demand periods during which the sanitizing operation can be most effectively carried out.

In a conventional water heater which activates the upper heating element as a priority there tends to develop a temperature gradient, with water in the upper portion of the tank being heated to the consumption temperature while the temperature of water in the tank decreases towards the lower portion of the tank. This allows bacteria to breed more readily in the lower portion of the tank. Thus, the thermostat may also be programmed to activate the lower heating element in response to the temperature read by the sensor associated with the upper heating element, both during the sanitizing cycle and at other times. Using the lower element to heat the whole tank causes the lower element to stay on for a longer period of time which in turn heats the annular zone of contamination to a higher temperature and thus eliminating the danger of bacterial contamination The thermostat is provided with a timer which determines the length of the sanitizing interval, allowing sufficient time to elapse during a sanitizing cycle, i.e. between the time that the hot water reaches the sanitizing temperature level and the time when the thermostat resets its temperature level to the preset consumption temperature, to destroy bacteria within the water tank.

There are a number of ways to start and control the length of the sanitizing interval, allowing sufficient time to elapse during a sanitizing cycle. Some of the methods are briefly described below, the methods can be used by themselves or mixed with other methods:

1. Using a clock, the sanitizing cycle is started at same time and same day on a regular basis.
2. Using under/over voltage to start the sanitizing cycle.
3. Sanitizing cycle controlled by onboard timer after being started by under/over voltage.
4. Sanitizing cycle is started by and the duration is controlled by under/over voltage.

Using power control, patented by the inventors under PCT/CA93/00288 titled "Power controller device", the thermostat can also control the increase and decrease of the temperature by controlling the amount of power available to the heating elements.

Hot water is delivered to the user through the top of the tank, and the user will mix cold water with the hot water at the dispensing fixture as required to reach the desired "consumption temperature" for any particular use, such as bathing, washing clothes, washing dishes, etc. Alternatively a mixing valve, controlled by the thermostat, can deliver pre-mixed water at the consumption temperature. Thus, in a typical household the user's hot water needs will be satisfied as long as water in the upper portion of the tank is kept at or above the consumption temperature. If one of the heating elements fails, water heated by the other element will rise to the top of the tank and hot water will thus still be available for the user, although not necessarily in the quantity desired.

SUMMARY OF THE INVENTION

The present invention thus provides a programmable thermostat for controlling a water heater having a power supply for activating upper and lower elements and a temperature sensor associated with each element, comprising a temperature monitoring circuit coupled to the temperature sensors, the thermostat being capable of being programmed to switch from a consumption mode, in which the thermostat deactivates the water heater when water in the water heater reaches a first consumption temperature, and a sanitizing mode, in which the thermostat deactivates the water heater when water in the water heater reaches a sanitizing temperature which is higher than the consumption temperature.

The present invention further provides a programmable thermostat for controlling a water heater having a power supply for activating upper and lower elements coupled to a temperature sensor associated with each element, the thermostat including a voltage monitoring circuit connected to the power supply and being capable of being programmed to switch from a consumption mode, in which the thermostat deactivates the water heater when water in the heater reaches a first consumption temperature, and a sanitizing mode, in which the thermostat deactivates the water heater when water in the water heater reaches a sanitizing temperature which is higher than the consumption temperature, in response to an increase or decrease in the power supply voltage beyond a preselected level.

The present invention further provides a water heater having upper and lower heating elements, a temperature sensor located adjacent to each heating element, and means for activating the lower heating element in response to a temperature of water in the water heater detected by the temperature sensor adjacent to the upper heating element.

The present invention further provides a water heater having upper and lower heating elements, a temperature sensor located adjacent to each heating element, and means for controlling the raise in temperature by controlling the amount of power available to each of the elements.

The present invention further provides means for storing data within the programmable thermostat, which sets the consumption temperature, sanitizing temperature, the power available to the element, and the number of elements to use. The stored data can be active for a period of time (minutes, hours or any other time unit), and different stored data can be active for each time period. The length of each time period can also be programmed.

The present invention further provides means for communication to re-program the data stored within the programmable thermostat.

The present invention further provides a method of controlling a water heater having a power supply for activating upper and lower elements and a temperature sensor associated with each element, comprising the steps of monitoring a temperature detected by the temperature sensors, and periodically switching between consumption mode, in which a thermostat deactivates the water heater when water in the water heater reaches a first consumption temperature, and a sanitizing mode, in which the thermostat deactivates the water heater when water in the water heater reaches a sanitizing temperature which is higher than the consumption temperature.

The present invention further provides means of controlling a mixing valve to deliver pre-mixed hot and cold water, at required temperature, to the dispensing fixture.

The present invention further provides a programmable thermostat for a water heater having at least two heating elements for heating water in the water tank, and switching means for activating each heating element independently, fault detection means for determining whether an activated heating element is functional, and means for activating an alternate heating element if the activated heating element is not functional.

BRIEF DESCRIPTION OF THE DRAWINGS

In drawings which illustrate by way of example only a preferred embodiment of the present invention.

DETAILED DESCRIPTION OF THE INVENTION

Figure 1:
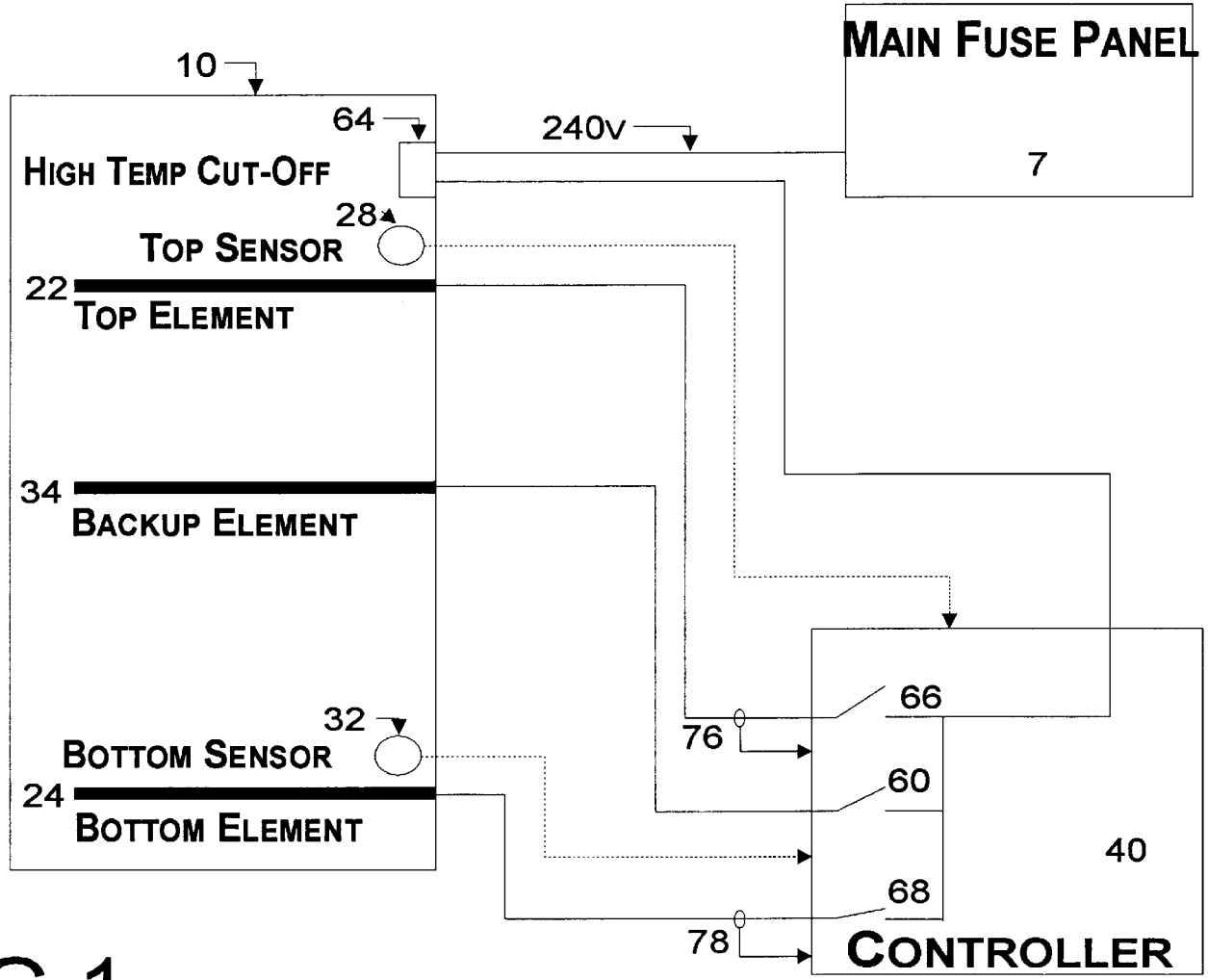
FIG. 1 is a block diagram of the system.

FIG. 1 illustrates the block diagram of the programmable thermostat system including the wiring diagram.

Figure 2:
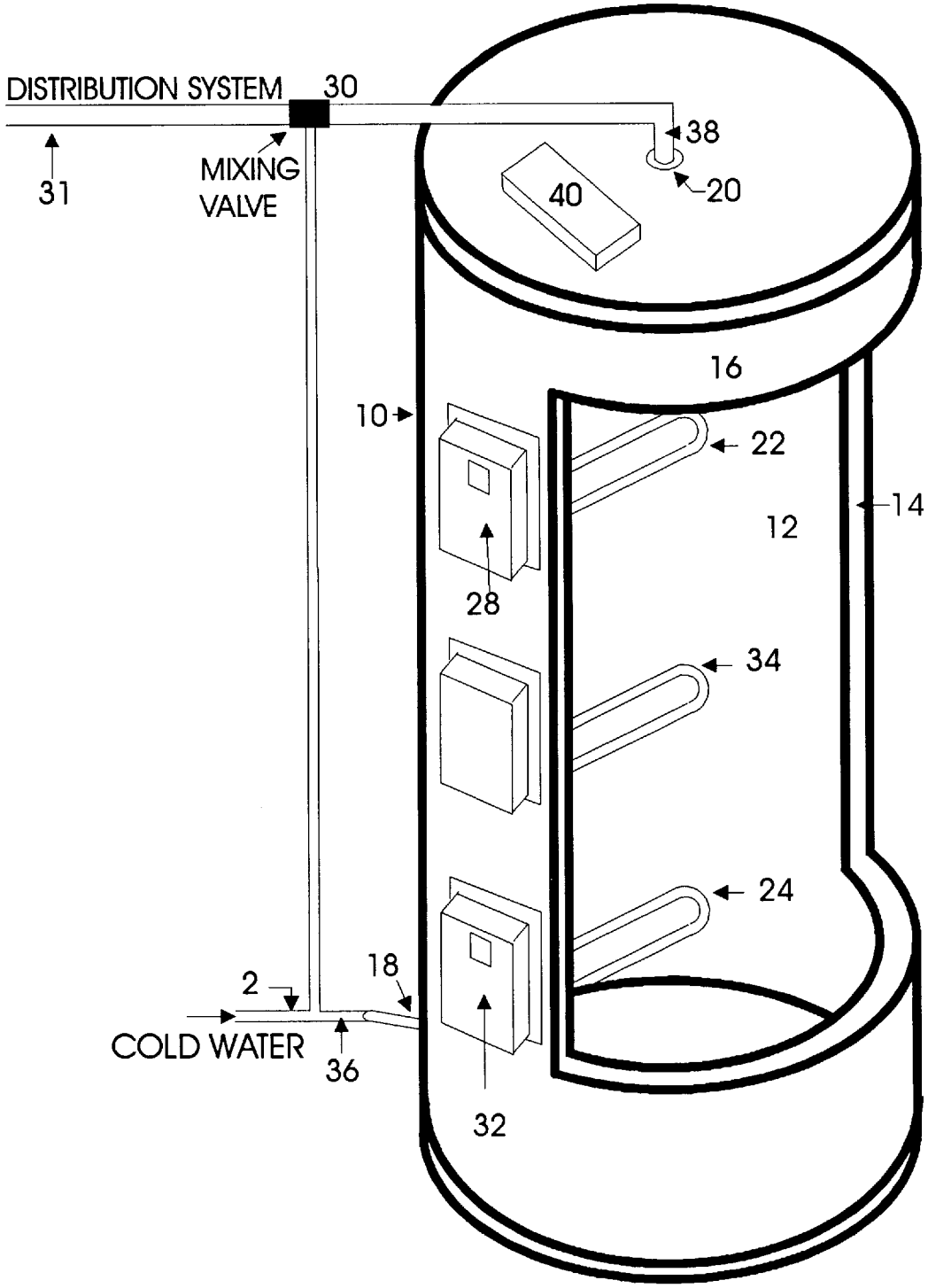
FIG. 2 is a cross section of a typical water heater.

FIG. 2 illustrates a conventional water heater 10 comprising a tank 12 surrounded by insulation 14 encased in a outer jacket 16. A cold water inlet 18 connects the cold water supply to the bottom of the tank 12, and a hot water outlet 20 delivers hot water to the user's distribution system from the top of the tank 12.

The water heater 10 is provided with upper and lower heating elements 22, 24 respectively, detachably connected to sealed receptacles (not shown) built into the wall of tank 12. A temperature sensor 28, 32, such as a thermistor, are located immediately adjacent to each of the upper and lower heating elements 22, 24.

In a conventional water heater the upper and lower elements 22, 24 are controlled by a thermostat through a conventional flip-flop circuit which alternately activates one or the other of the elements 22, 24 according to the temperature sensed by the temperature sensors 28, 32 associated with each element. Typically the upper element 22 is activated first, to heat water in the upper portion of the tank 12, and during other periods the lower element 24 is activated to bring the remaining water in the tank 12 up to the preset consumption temperature desired by the user, which is generally between 50 and 60 degree C.

The upper element 22 is activated first, as it heats a smaller portion of tank 12 and thus provides the user with hot water in shorter time.

The present invention in a preferred embodiment utilizes a programmable thermostat 40, illustrated in FIG. 2, to control the activation of the heating elements 22 and 24. The thermostat 40 is connected to the temperature sensors 28 and 32 through a flip-flop circuit in micro-controller 42, and most of the time operates in a consumption mode, activating and deactivating the heating elements 22 and 24 in the conventional fashion.

According to the invention the thermostat 40 includes means for switching from consumption mode to a sanitizing mode. In one preferred embodiment a timer circuit regularly switches the thermostat 40 to the sanitizing mode at predetermined intervals.

According to another preferred embodiment of the invention, the thermostat 40 is provided with a voltage sensor circuit 44 which continually monitors the supply voltage. The thermostat 40 is programmed to detect an increase or decrease in the supply voltage beyond a preset level, which may be about 7% beyond the nominal supply voltage, and to respond to such a voltage swing by switching to the sanitizing mode. The sanitizing mode is active only when the voltage is beyond the preset value.

According to another preferred embodiment of the invention, the thermostat 40 is provided with a voltage sensor circuit 44 which continually monitors the supply voltage. The thermostat 40 is programmed to detect an increase or decrease in the supply voltage beyond a preset level, which may be about 7% beyond the nominal supply voltage, and to respond to such a voltage swing by switching to the sanitizing mode. The length of the sanitizing mode controlled by the timer circuit.

During the sanitizing cycle:

1. The thermostat shut-off temperature increases from the consumption temperature in the range of 50 to 60 degree C. typically, to super heat water in the tank 12 to a sanitizing temperature preferably in the range of 60 to 70 degree C. typically; and
2. The flip-flop circuit in micro-controller 42 is circumvented. The thermostat 40 either activates both heating elements 22 and 24 simultaneously to raise water throughout the tank 12 to the sanitizing temperature, or the thermostat 40 activates the lower heating element 24 and deactivates the lower element 24 according to the temperature detected at the upper temperature sensor 28.

To prevent water at higher then consumption temperature, during or after sanitizing cycle, from reaching a dispensing fixture, a mixing valve 30, within the distribution system, is controlled by stepper motor 46 to pre-mix cold water and hot water from outlet 20, to reduce the temperature of water within the distribution system.

Temperature sensor 31, as shown in FIG. 2, is used to set the ratio of cold water mixed with hot water from outlet 20 to reduce the temperature of water within the distribution system.

The invention may be designed exclusively to activate both heating elements 22 and 24 during each sanitizing cycle, or may be designed exclusively to activate only the lower heating element 24. The primary difference is that the former will heat the water faster, and thus shorten the sanitizing cycle, but will utilize more power in the process.

In another embodiment the invention may be designed to allow for selectively activating both heating elements 22 and 24 or only the lower heating element 24. Whether both heating elements 22 and 24 are activated simultaneously, or only the lower heating element 24 is activated responsive to the temperature detected by the upper sensor 28, can be controlled by the local electrical utility according to the amount of excess electricity available. For example, a sanitizing cycle initiated by a natural overvoltage condition occurring during a low power demand period might activate both heating elements 22 and 24 to use up excess electrical energy and minimize "freewheeling" (a condition in which electrical turbines are spinning but the energy being produced is not being used, or the turbines are being used as load to lower the line voltage). On the other hand, a sanitizing condition initiated by the utility after a lengthy power outage, by deliberately creating a voltage swing to switch the thermostats controlling water heaters in a particular locale to the sanitizing mode, might activate only the lower heating element 24 to avoid diverting too much electrical power to water heaters in the affected region.

The thermostat 40 can be programmed to adopt the fast superheating sanitizing mode, in which both elements 22 and 24 are activated simultaneously, or the slow superheating sanitizing mode, in which only the lower element 24 is activated, according to the duration of the voltage swing interval. For example, a momentary voltage spike of a selected short duration, which is relatively easy for the electrical utility to create, can be used to command the thermostat 40 to switch to the slow superheating sanitizing mode; a longer voltage swing interval, which is more likely to occur naturally during low power demand periods, can command the thermostat to switch to a fast superheating sanitizing mode using both elements 22 and 24.

The timer circuit 48 can be activated to time the sanitizing cycle if required. When the timer signals that the sanitizing cycle is complete, the thermostat 40 automatically switches back to the consumption mode, and the superheated water in the water heater 10 is permitted to cool down to the consumption temperature in the typical range of 50 to 60 degree C.

It will be appreciated that the sanitizing cycle may also be initiated periodically by the timer circuit 48 for routine sanitizing of the water heater 10, preferably during low power demand periods, or may be active only during the over/under voltage condition of the power line.

By dividing time into shorter time frame (for example an hour, or a day), the needs of the user and the electrical utility company can be achieved. By using lower consumption temperature during peak electrical demand time, can help the electrical utility by lowering the demand and by setting higher consumption or normal consumption temperature during other times can ensure the user does not run out of hot water. Also by controlling the power to each element and the number of elements to use within a time period, helps the electrical utility by lowering the demand even further, while adjusting the sanitizing period can help with life style of the user.

To meet the demands of the electrical utility and the user the following parameters have to be set for each time period which may be minutes, hours or any other time period:

1. Consumption temperature:
   Temperature of hot water supplied to the user at outlet 20.
2. Sanitizing temperature:
   Temperature at which the legionellosis is reduced or killed.
3. Sanitizing interval:
   If using timer to activate sanitizing cycle then specify the time between the sanitizing cycle.
4. Voltage swings:
   Over voltage or under voltage to start/stop the sanitizing cycle.
5. Voltage swing duration:
   Length of time that the voltage must change for the programmable thermostat to recognize the change.
6. Power supplied to the element:
   Amount of power to be supplied to each element to control the temperature of the water within the water heater 10.
7. Element to use during a time period:
   Number of elements to use within a water tank in a given time period.
8. Duration of each cycle:
   Different consumption cycles and sanitizing cycles can be programmed into the programmable thermostat, each cycle can have different control parameters (e.g. consumption temperature can be different in each consumption cycle). The time of the cycle is entered here, the time can be in minutes, hours or any other time unit.

The time periods and the parameters can be programmed into the programmable thermostat remotely or by a keypad (not shown) either by the user or the electrical utility company.

Figure 3A:
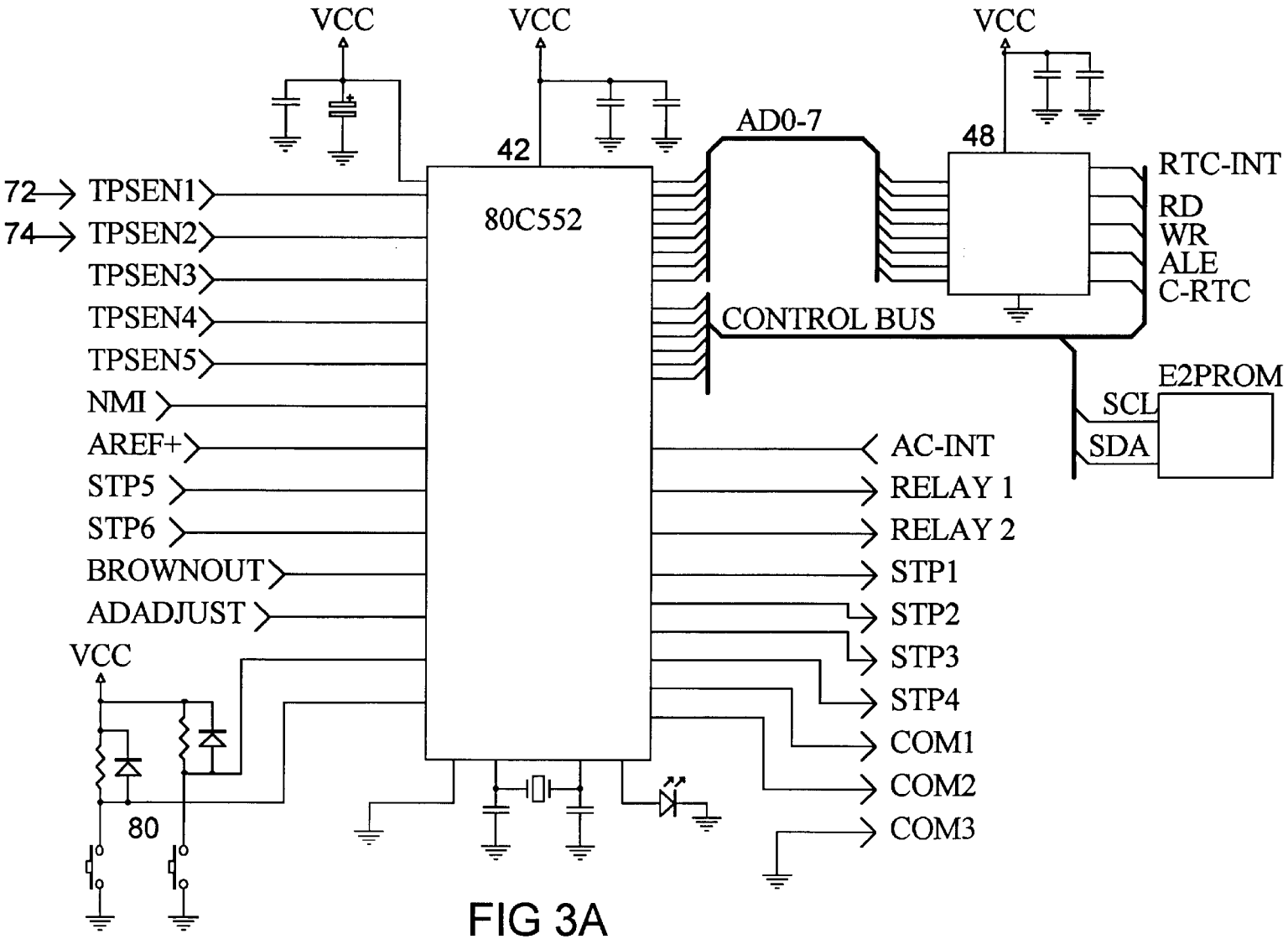
FIG. 3*a* is a schematic diagram showing the micro-controller and the memory section.
Figure 3B:
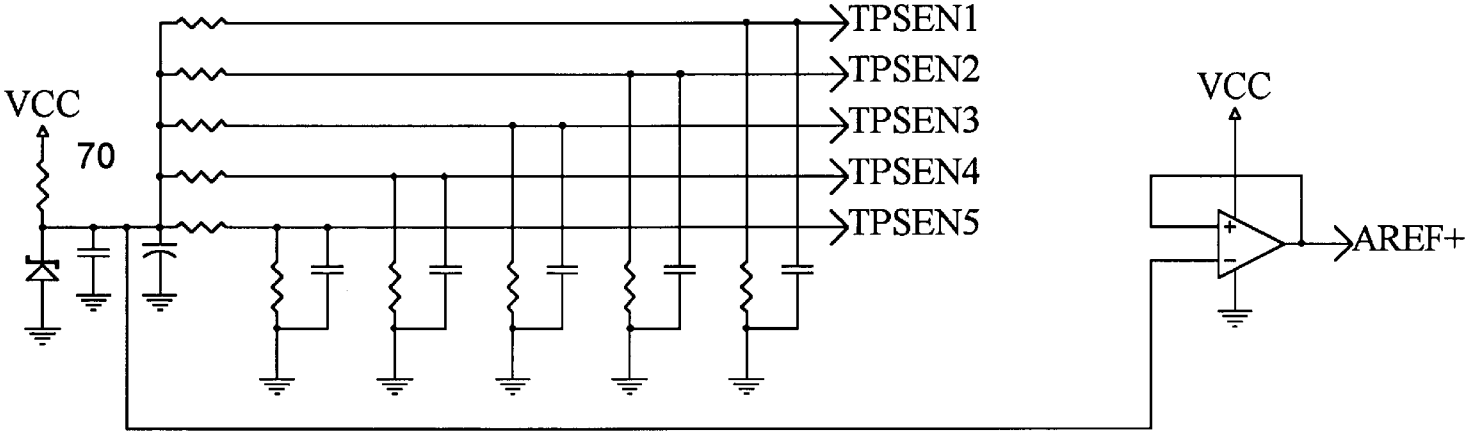
FIG. 3*b* is a schematic diagram showing temperature monitoring circuit.
Figure 3C:
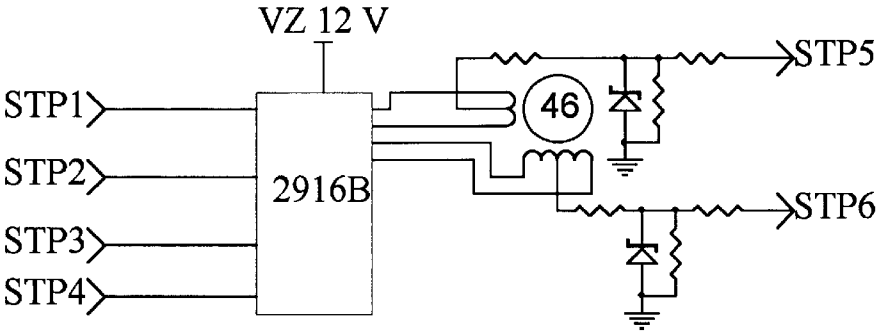
FIG. 3*c* is a schematic diagram showing stepper motor controller section.
Figure 3D:
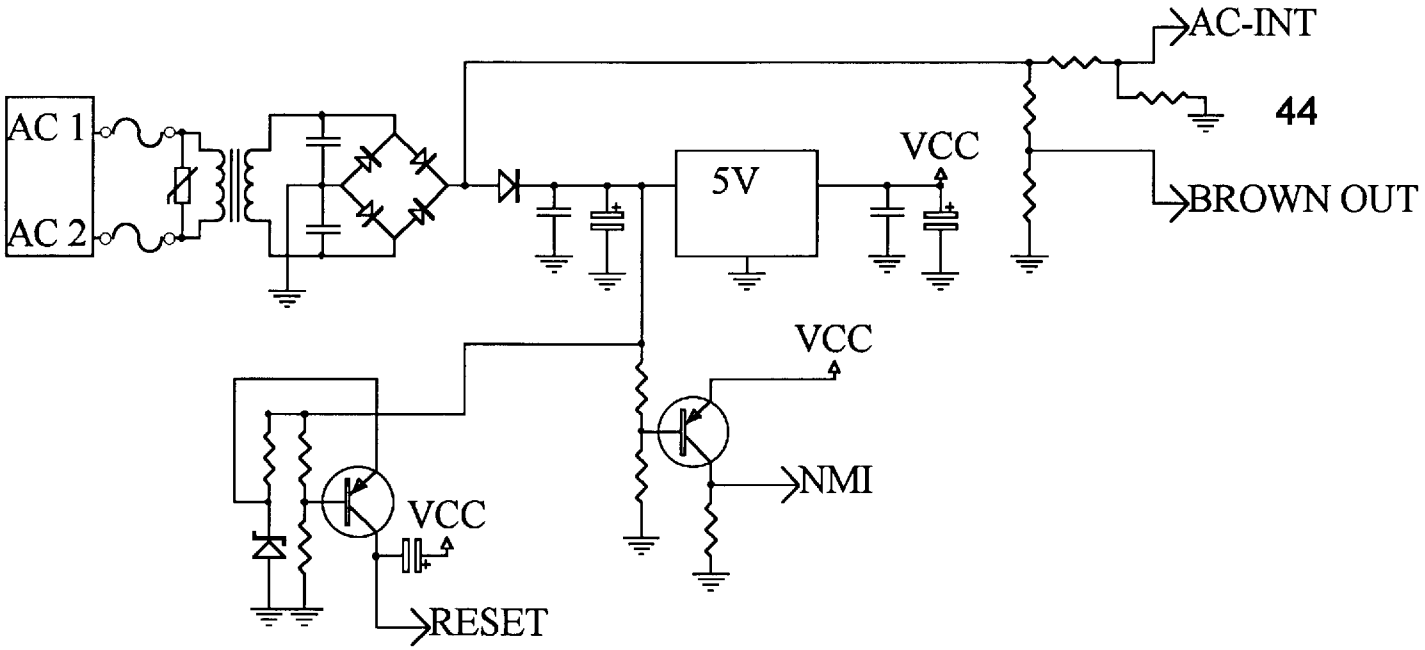
FIG. 3*d* is a schematic diagram showing power supply section.
Figure 3E:
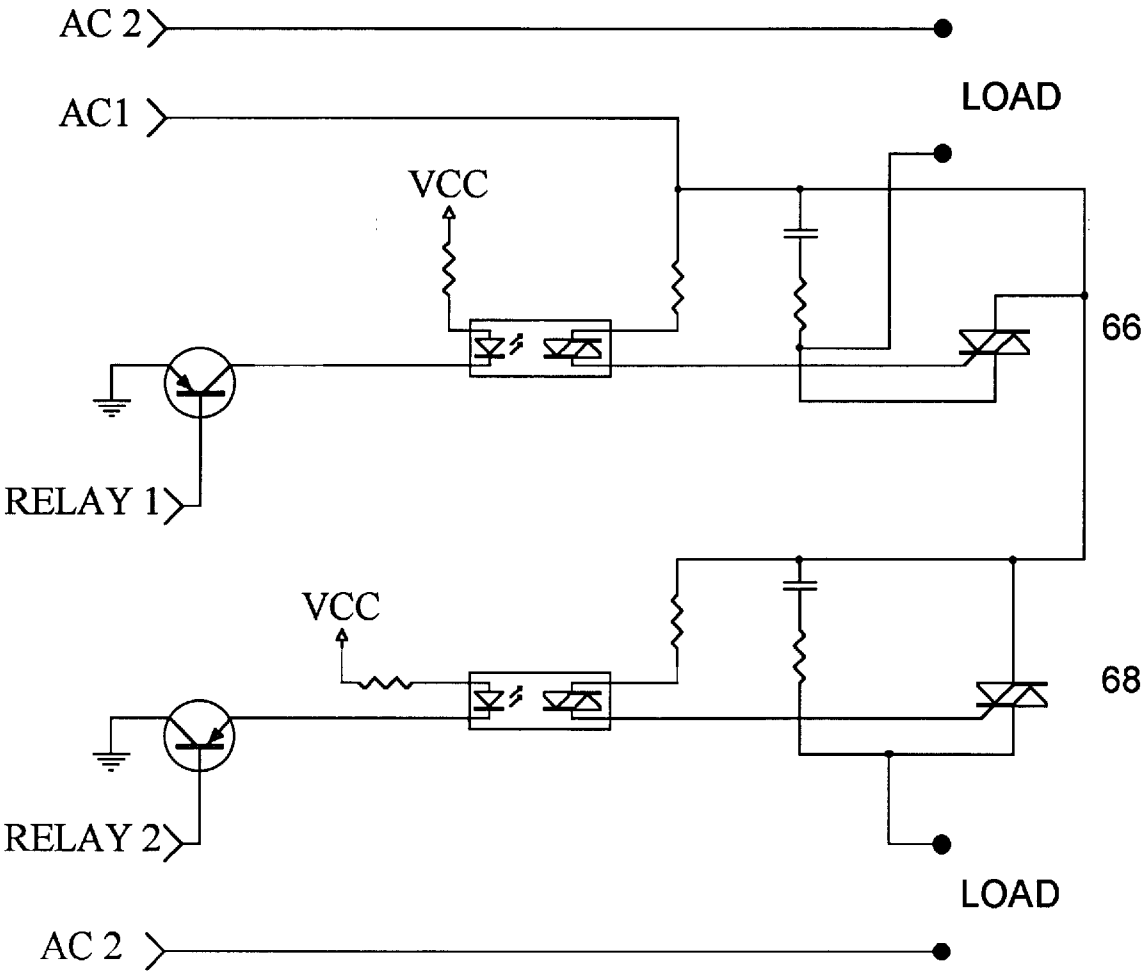
FIG. 3*e* is a schematic diagram showing switches for top and bottom heating elements.
Figure 3F:
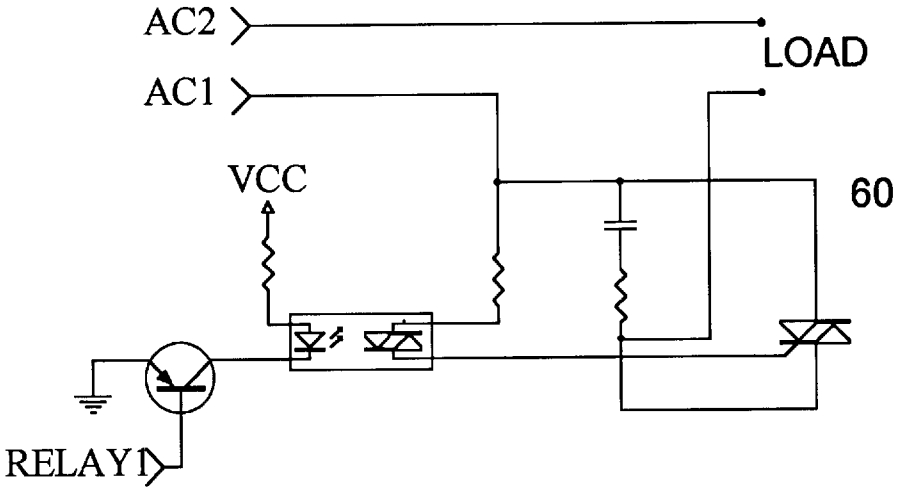
FIG. 3*f* is a schematic diagram showing a switch for auxiliary heating element.

In a preferred embodiment the thermostat 40 also includes switching means 60, illustrated in FIG. 3F, for activating a backup element in response to a signal from the micro-controller 42 that one of the elements 22, 24 has failed. The micro-controller 42 may determine this through the temperature sensor 28, 32 or through conventional current measuring means (not shown) connected to each heating element 22, 24 to detect the current draw of the activated element. Alternatively, since only one element can be active at any time, a single current sensor connected to the load supply wires will accomplish the same result.

In a first embodiment, in the event that the micro-controller 42 activates a heating element 22 or 24, and after a short delay the temperature sensed by its associated sensor 28 or 32 does not rise, the micro-controller 42 will automatically switch the flip-flop circuit to deactivate that element and activate the other of the heating elements 22, 24 as backup. For example, if the temperature sensor 28 senses a temperature below the set temperature, the micro-controller 42 will activate the heating element 22 to raise the temperature of water in the upper portion of the tank 12 to set the temperature. If the element 22 does not respond, a fault condition is assumed and the micro-controller 42 will activate the element 24 automatically. A warning light may be provided to notify the user of the faulty element 22, and also the electrical utility company can be notified of the fault via the remote communication means.

Optionally, an auxiliary heating element 34 may be provided in the water tank 12, preferably located either midway between the two heating elements 22, 24 or adjacent to the lower heating element 24. The auxiliary element 34 would be activated by the micro-controller 42, through a relay/triac 60, only when one of the primary element 22, 24 has failed, as described above. A separate thermostat for the auxiliary element 34 is therefore unnecessary.

For this monitoring function the micro-controller 42 includes a monitoring circuit 70, illustrated in FIG. 3B, which monitors the status of the heating element 22 or 24 at all times when an element is activated. In one preferred embodiment this is accomplished by monitoring the temperature of the heating elements 22, 24 through the temperature sensor 28, 32 as described above. This monitoring circuit 70 is subject to a time delay of 10 to 20 seconds after activation of the element, to prevent a "failed element" reading immediately after the power to element is switched on, while the element is still cool. Following this delay the micro-controller 42 reads the temperature sensors 28 or 32 as an analog to digital convertor (ADC) count from the associated heating element 22 or 24. The ADC output changes proportionately with the thermistor output, so that at any time when the element 22 or 24 is activated, after the initial delay, if the temperature detected by the associated sensor 28 or 32 does not increase then the micro-controller 42 will switch the flip-flop circuit to activate the other of the heating elements 22, 24 (or an auxiliary element 34). The micro-controller 42 can time stamp the failed element and record the information for a technician, and also display an alarm for the user and also call the local electrical utility company with fault indication.

In an analog variation of this embodiment, the micro-controller 42 applies a signal to the reference input of a comparator (not shown) associated with each heating element 22, 24 respectively, and the temperature sensor 28 or 32 supplies a signal to the other input of the comparator associated with that element. So long as the thermistor output exceeds the reference level the output of the comparator is high. At any time when an element 22 or 24 is activated, after the initial delay, if the temperature sensed by its associated sensor 28, 32 does not change then the micro-controller 42 will switch the element as described above.

In an alternate embodiment a monitoring circuit monitors the current drawn by each element using a voltage and current sensor such as LEM USA Inc. part LA100-P, which sends a signal to the ADC input that exceeds the reference level, which condition should exist whenever a properly working heating element 22, 24 is activated. If the current draw of a heating element 22, 24 drops, due to a fault in an element, the ADC count associated with the failed element goes low and the micro-controller 42 switches to other element (or an auxiliary element 34) as described above. In this embodiment no time delay is required, since the current draw of an element is measurable as soon as the element is activated.

To further enhance the thermostat 40, the heating elements are deactivated when ever the temperature sensors are shorted or opened by the user in an attempt to get more hot water or water at a higher temperature.

It is advantageous to provide a programmable thermostat 40, which can be programmed locally or by remote means to lower the maximum temperature setting during periods when local utility anticipates peak power demand, to promote load shifting. This allows the elements 22, 24 to off for a longer periods of time. The programming can include alternate settings for weekends, vacations and intermittent uses (such as summer cottage), with an optional override switch accessible to the power utility company or the user.

It will be recognized that all aspect of the invention can be used to control water heaters that use different types of fuel to heat the water. For example controlling the length of time that a burner is turned on in a oil fired water tank will give water at consumption temperature or at sanitized temperature.

It will be understood that, although various features of the invention have been described with respect to one or another of the embodiments of the invention, the features and embodiments of the invention may be combined or used in conjunction with other features and embodiments of the inventions as described and illustrated herein. Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

What is claimed is:

1. A programmable thermostat for controlling a fluid heater with a temperature sensor associated with each heating element, comprising a top and a bottom heating element and a temperature monitoring circuit coupled to the temperature sensors, the thermostat being programmable to switch from a consumption mode, in which the thermostat deactivates a heating element when it's associated temperature sensor reaches a first consumption temperature, and a sanitizing mode, in which the thermostat deactivates the bottom heating element when temperature sensor associated with the top heating element reaches a sanitizing temperature.

2. The programmable thermostat of claim 1 including means for monitoring the power supply.

3. The programmable thermostat of claim 2 wherein the thermostat switches between a consumption mode in which the thermostat deactivates a heating element when it's associated temperature sensor reaches a first consumption temperature, and a sanitizing mode, in which the thermostat deactivates the bottom heating element when temperature sensor associated with top heating element reaches a sanitizing temperature, in response to change in the voltage of the power supply.

4. The programmable thermostat of claim 3 wherein the change is an over voltage interval.

5. The programmable thermostat of claim 3 wherein the change is an under voltage interval.

6. The thermostat of claim 1 including a timer circuit.

7. The thermostat of claim 6 wherein the thermostat periodically switches between a consumption mode, in which the thermostat deactivates a heating element when it's associated temperature sensor reaches a first consumption temperature, and a sanitizing mode, in which the thermostat deactivates the bottom heating element when temperature sensor associated with top heating element reaches a sanitizing temperature.

8. The thermostat of claim 1 including switching means for activating each heating element independently, fault detection means for determining whether an activated heating element is functional, and means for activating an alternate heating element if the activated heating element is not functional.

9. The thermostat of claim 1 in which the thermostat is remotely programmable.

10. The thermostat of claim 1 in which the thermostat is programmable using a removable keypad.

11. The programmable thermostat of claim 1 wherein the fluid heater is deactivated in response to shorted temperature sensor.

12. The programmable thermostat of claim 1 wherein the fluid heater is deactivated in response to opened temperature sensor.

13. The programmable thermostat of claim 1 including the means of controlling a tempering valve.

14. The programmable thermostat of claim 13 wherein the tempering valve controls the ratio of cold fluid mixed with hot fluid to reduce the temperature of fluid at a dispensing fixture.

15. The programmable thermostat of claim 14 wherein the ratio of cold fluid mixing with hot fluid, within the tempering valve, is set in response to a temperature sensor at the dispensing fixture.

* * * * *